US011617480B2

(12) United States Patent
Wimberly

(10) Patent No.: US 11,617,480 B2
(45) Date of Patent: Apr. 4, 2023

(54) ERGONOMIC TOILET SEAT APPARATUS AND ASSEMBLY

(71) Applicant: Harrell Edward Wimberly, Columbia, SC (US)

(72) Inventor: Harrell Edward Wimberly, Columbia, SC (US)

( * ) Notice: Subject to any disclaimer, the term of this patent is extended or adjusted under 35 U.S.C. 154(b) by 0 days.

(21) Appl. No.: 17/448,416

(22) Filed: Sep. 22, 2021

(65) Prior Publication Data

US 2022/0095861 A1 Mar. 31, 2022

Related U.S. Application Data

(60) Provisional application No. 63/198,106, filed on Sep. 29, 2020.

(51) Int. Cl.
*A47K 13/24* (2006.01)
*A47K 13/12* (2006.01)

(52) U.S. Cl.
CPC ..... *A47K 13/24* (2013.01); *A47K 13/12* (2013.01)

(58) Field of Classification Search
CPC ..... A47K 13/10; A47K 13/00; A47K 13/24
USPC ..... 4/667
See application file for complete search history.

(56) References Cited

U.S. PATENT DOCUMENTS

| | | | | |
|---|---|---|---|---|
| 906,053 | A * | 12/1908 | McAuliffe | A47K 13/00 4/237 |
| 2,379,400 | A * | 6/1945 | Hoffman | A47K 13/00 D23/311 |
| 3,786,522 | A | 1/1974 | Kira et al. | |
| 4,048,679 | A | 9/1977 | Garnett | |
| 5,809,583 | A | 9/1998 | Pucciani | |
| 6,385,783 | B1 | 5/2002 | Eliason | |
| 7,216,374 | B2 | 5/2007 | Hassan | |
| 9,293,024 | B2 | 3/2016 | Cheng | |
| 10,292,549 | B2 | 5/2019 | Kim | |
| 10,633,848 | B1 | 4/2020 | Luper | |
| 2008/0005829 | A1 | 1/2008 | Chen | |
| 2008/0222783 | A1 | 9/2008 | Mattioli | |
| 2008/0313796 | A1 | 12/2008 | Wendt | |
| 2009/0019629 | A1* | 1/2009 | Bakmadzhyan | E03D 11/02 4/420 |
| 2016/0100721 | A1 | 4/2016 | Byrd et al. | |
| 2019/0290079 | A1 | 9/2019 | Takaki et al. | |
| 2019/0369085 | A1 | 12/2019 | Tan et al. | |
| 2021/0244243 | A1* | 8/2021 | Sharon | A47K 17/028 |

FOREIGN PATENT DOCUMENTS

| | | | | |
|---|---|---|---|---|
| WO | WO-2010142368 | A2 * | 12/2010 | A47K 13/00 |

* cited by examiner

*Primary Examiner* — Christine J Skubinna
(74) *Attorney, Agent, or Firm* — Dunlap Bennett & Ludwig, PLLC

(57) ABSTRACT

An ergonomic toilet seat assembly is disclosed. The assembly includes a toilet seat that has a front portion with a front end portion and a rear portion with a rear end portion. The toilet seat defines a relief area, in an intermediate portion thereof, that is lower in height than a height of the front end portion and a height of the rear end portion. In use, the relief area receives a lower portion of a user's pelvis.

10 Claims, 4 Drawing Sheets

ERGONOMIC TOILET SEAT APPARATUS AND ASSEMBLY

CROSS-REFERENCE TO RELATED APPLICATION

This application claims the benefit of priority of U.S. provisional application number 63/198,106, filed Sep. 29, 2020, the contents of which are herein incorporated by reference.

BACKGROUND OF THE INVENTION

The present invention relates to toilet seats, and more particularly to an ergonomic toilet seat assembly.

Currently available toilet seats may not alleviate and may cause poor spinal alignment. Currently available toilet seats may contribute to discomfort and conditions of portions of the lower pelvis including but not limited to the ischial tuberosities and the sacrum. Currently available toilet seats further may distribute most of the pressure of sitting thereon to the bony areas of the pelvis. This poor pressure distribution may be a key culprit in the etiology of pressure-related skin breakdown in medically fragile populations. Currently available toilet seats may further cause or contribute to posterior pelvic rotation, and a slumping in the lower trunk through the promotion of posterior pelvic rotation. These problems may result in a mechanical impediment to waste movement through the lower digestive tract, and may also lead to further problems of discomfort, foot numbness and straining during evacuation.

As can be seen, there is a need for a solution to one or more of these problems.

SUMMARY OF THE INVENTION

In one aspect of the present invention, a toilet seat includes a front portion with a front end portion and a rear portion with a rear end portion, with the toilet seat further defining a relief area, in an intermediate portion thereof, that is lower in height than a height of the front end portion and a height of the rear end portion.

In another aspect of the present invention, a toilet seat assembly includes: a toilet seat including a front portion with a front end portion and a rear portion with a rear end portion, with the toilet seat further defining a relief area, in an intermediate portion thereof, that is lower in height than a height of the front end portion and a height of the rear end portion; and a toilet lid configured to support a lower back of a user.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 2:
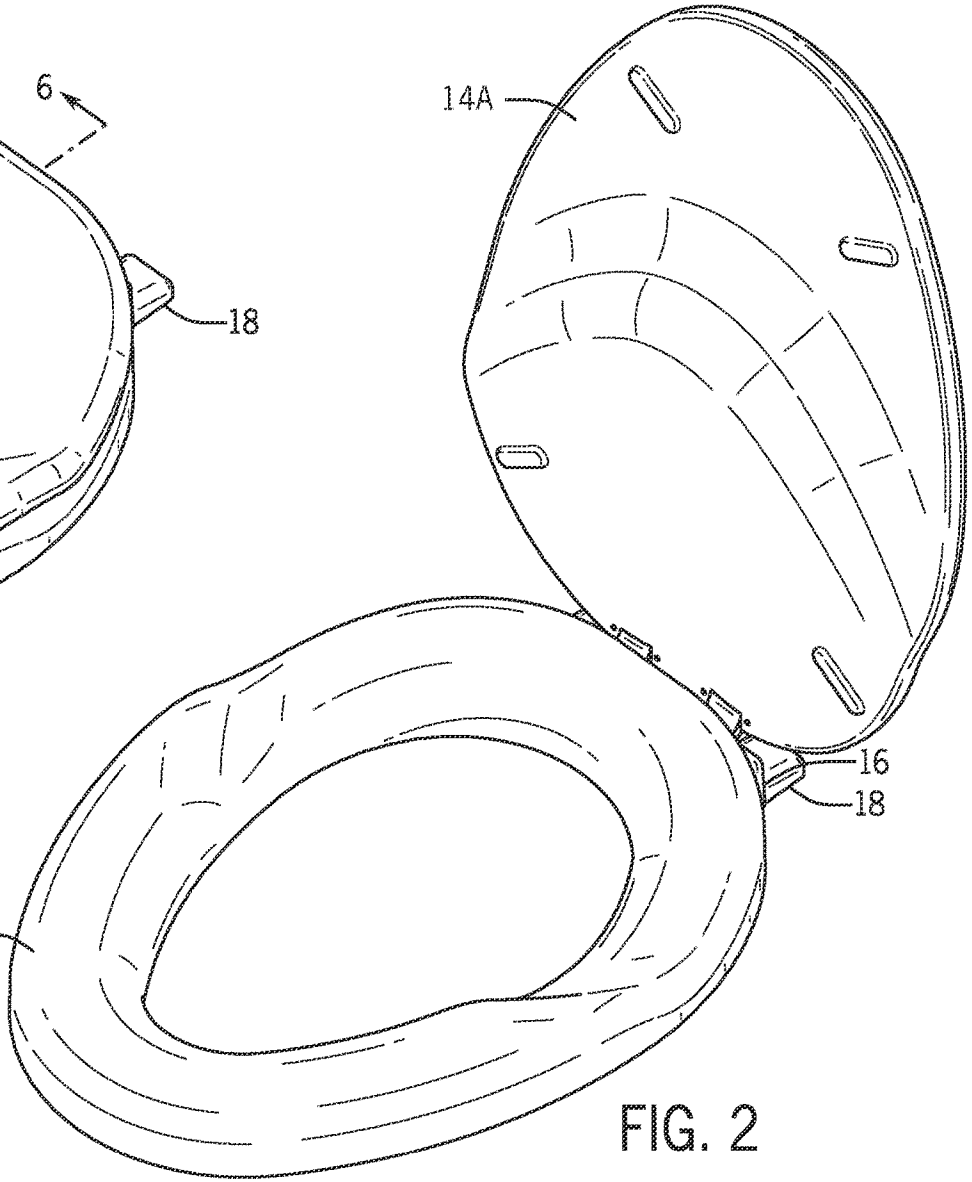
FIG. 2 is a top perspective view of the embodiment of the present invention, showing the lid in an open position.
Figure 1:
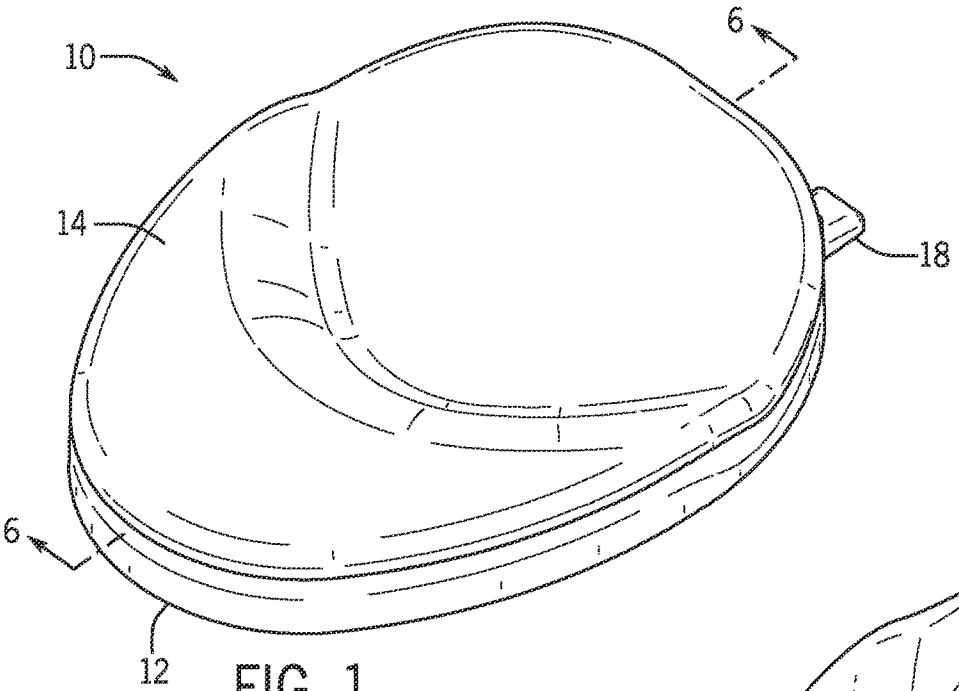
FIG. 1 is a top perspective view of an embodiment of the present invention, showing a lid of a toilet seat in a closed position.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention may provide an ergonomic toilet seat assembly. In an exemplary embodiment, the present invention may comprise an ergonomically correct toilet seat assembly which offers better pressure distribution and comfort and promotes easier evacuation.

The ergonomic toilet seat assembly of the present invention may not only solve many problems not addressed by currently available toilet seats but may also prevent further problems caused by currently available toilet seats.

The ergonomic toilet seat assembly of the present invention may effectively remove pressure from the bony areas of the pelvis and combat the poor spinal alignment encouraged with standard toilet seats. Such other toilet seats cause a slumping in the lower trunk through the promotion of posterior pelvic rotation. Such other toilet seats distribute most of the pressure of sitting to the bony areas of the pelvis. This may result in discomfort, foot numbness and straining during evacuation. This poor pressure distribution may also be a key culprit in the etiology of pressure-related skin breakdown in medically fragile populations.

In an exemplary embodiment, the ergonomic toilet seat assembly of the present invention may provide anatomically correct position of sitting and posture. This anatomically correct position provided and promoted by the ergonomic toilet seat assembly of the present invention may simultaneously decrease pressure and promote proper pelvic and spinal alignment, and thereby decrease mechanical impediment to waste movement through the lower digestive tract.

As stated above, the ergonomic toilet seat assembly of the present invention may remove pressure from the bony areas of the pelvis and combat poor spinal alignment encouraged with standard toilet seats. The ergonomic toilet seat assembly of the present invention may solve this problem by providing a surface which correctly fits the anatomy of the human pelvis and the adjacent posterior thigh to remove pressure points and to better align the digestive tract for elimination of waste. The ergonomic toilet seat assembly of the present invention may move pressure away from the bony prominences of the pelvis and onto the fleshier parts of the posterior thigh. The ergonomic toilet seat assembly of the present invention may further help with the process of waste evacuation by positioning anatomy in the most advantageous position for such.

The ergonomic toilet seat assembly of the present invention differs from and distinguishes over what currently exists. Unlike other toilet seats, the ergonomic toilet seat assembly of the present invention may offer many advantages. The ergonomic toilet seat assembly of the present invention may address the disparity between the plane of the posterior thigh and the position of the bottom of the pelvis. The ergonomic toilet seat assembly of the present invention may unload the bony prominences and align the pelvis in an anterior rotation for better spinal alignment and improved evacuation. The ergonomic toilet seat of the present invention adequately addresses normal human anatomy, and actively promotes proper ergonomics. Normal sitting posture does not occur on one plane and the ergonomic toilet seat assembly of the present invention may provide customized consideration for the different positions of the bony components of the seating area of the human body, as well as the joints which directly affect these positions.

The ergonomic toilet seat assembly of the present invention may provide anatomically correct relief for the lower pelvis parts, ischial tuberosities, as well as the sacrum, which simultaneously decreases pressure and promotes proper pelvic and spinal alignment and therefore decreased mechanical impediment to waste movement through the lower digestive tract.

Figure 3:
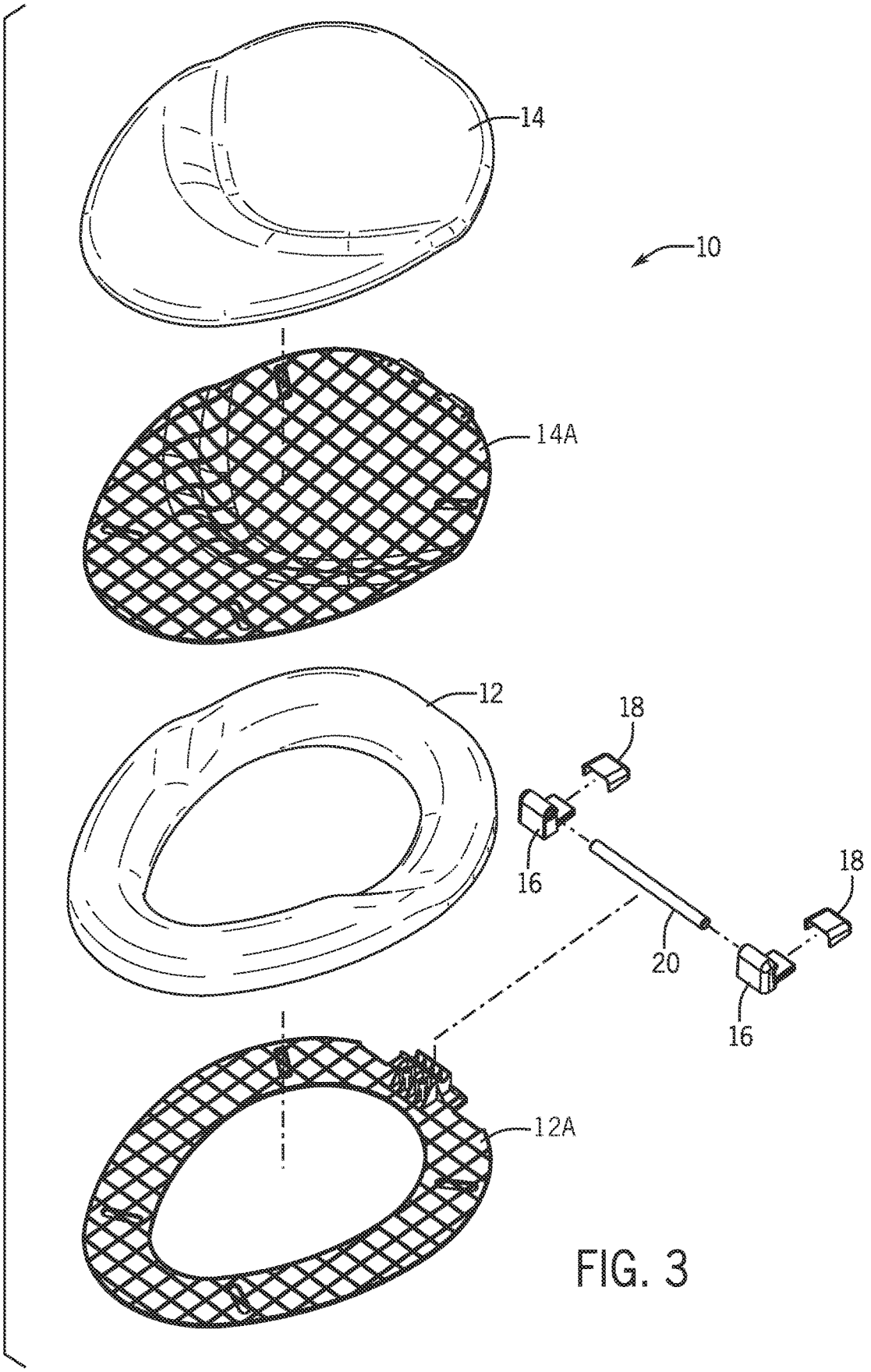
FIG. 3 is an exploded perspective view of the embodiment of the present invention.
Figure 4:
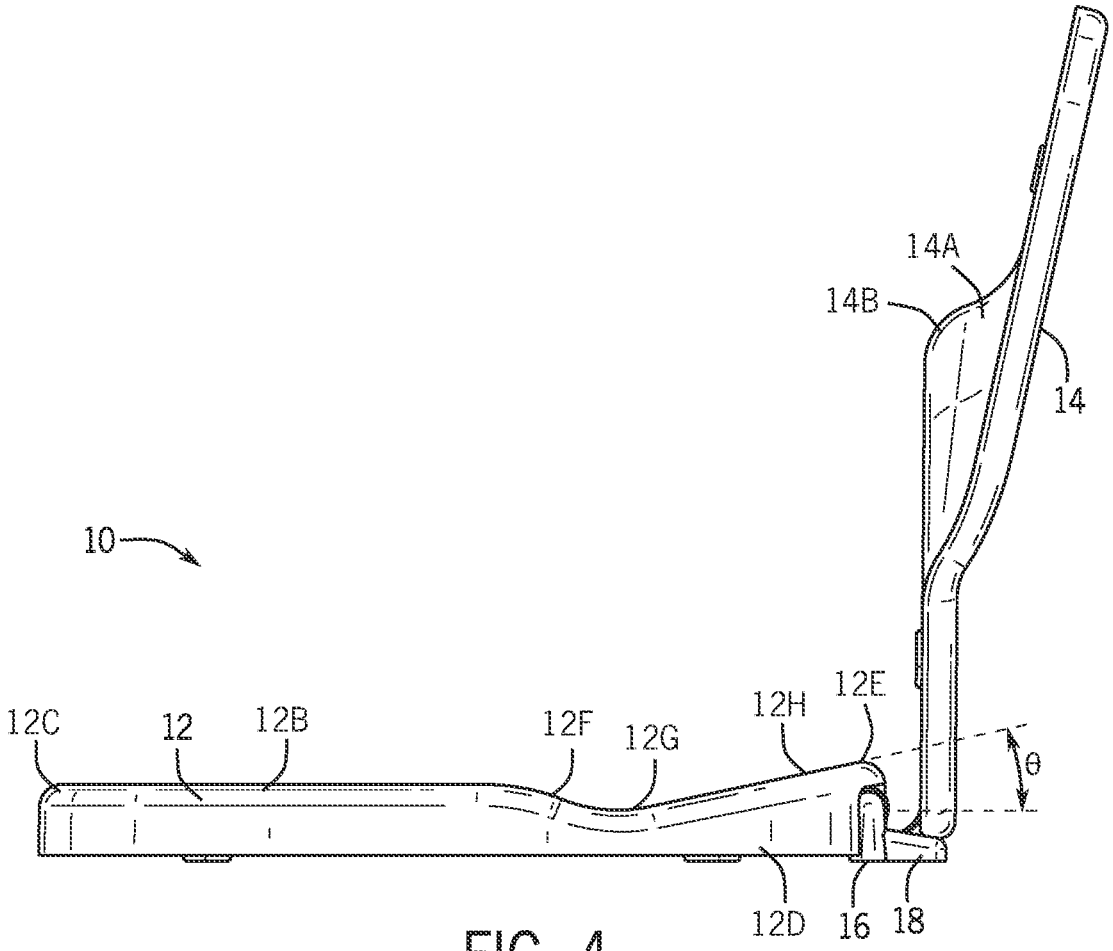
FIG. 4 is a side elevation view of the embodiment of the present invention, showing the lid in an open position.
Figure 5:
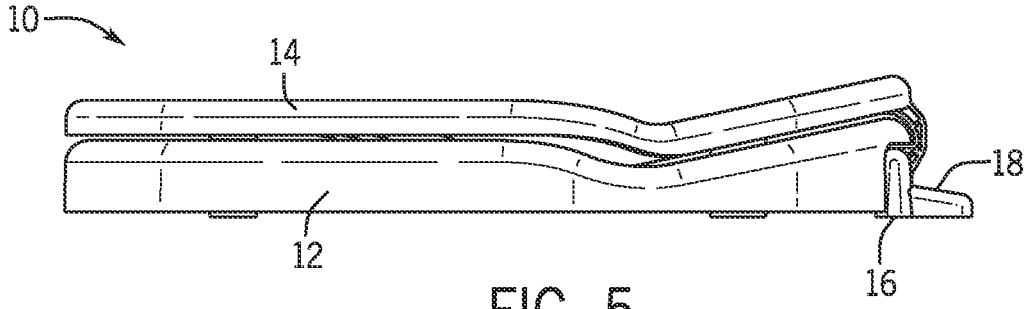
FIG. 5 is a side elevation view of the embodiment of the present invention, showing the lid in a closed position.
Figure 6:
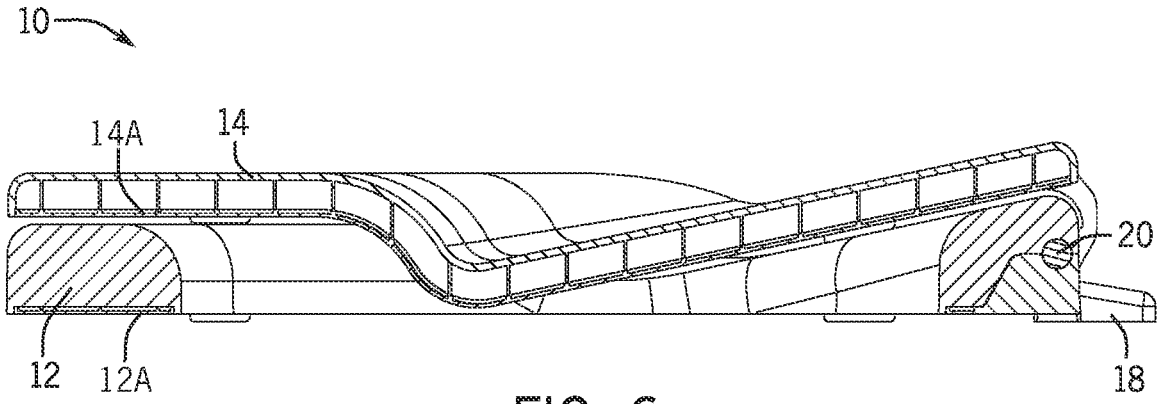
FIG. 6 is a cross-sectional view of the embodiment of the present invention, taken on line 6-6 of FIG. 1, with the embodiment being compressed lengthwise in order to illustrate certain details at distal ends thereof.
Figure 7:
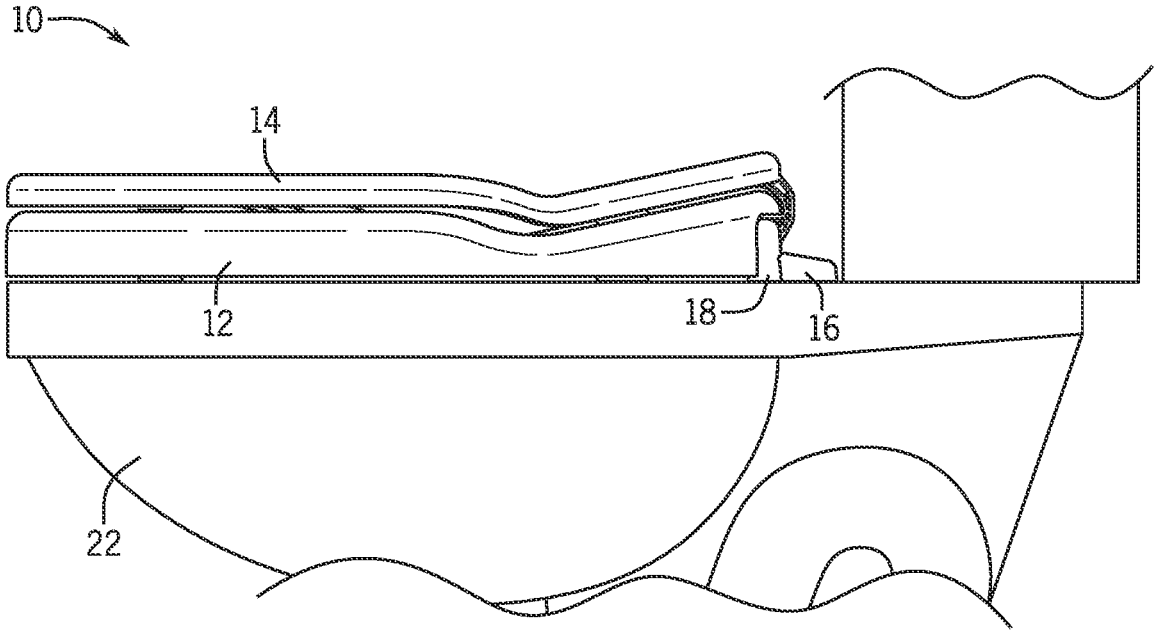
FIG. 7 is a side elevation view of the embodiment of the present invention, showing the toilet seat in use.

Referring now to FIGS. 1-7, an ergonomic toilet seat assembly 10 includes an ergonomic toilet seat 12, a corresponding toilet seat lid 14, and a hinge assembly 16, 18, 20 between and connecting the lid 14 and the seat 12. The seat 12 and lid 14, respectively, may be structurally supported by ribbing. As shown, for example, in FIGS. 3, 4, and 6, a toilet seat cover 12*a* may be coupled to an underside of the toilet seat 12, and a lid cover 14*a* may be coupled to an underside of the lid 14. These covers 12*a*, 14*a* conceal the ribbing from view during normal uses of the toilet seat assembly 10. As shown in FIG. 3, the hinge assembly 16, 18, 20 may include connecting hinge tabs 16, covers 18 for the tabs, and a hinge bar 20 that pivotally connects to the seat 12 and the lid 14. The hinge tabs 16, in use, connect to a toilet bowl 22, and as shown in FIG. 7.

In an exemplary embodiment, the ergonomic toilet seat 12 of the present invention may comprise a front portion 12B and a rear portion 12D. As shown, the front portion 12B has a front end portion 12C at a distal end thereof, and the rear portion 12D of a rear end portion 12E at a distal end thereof. In some embodiments, the ergonomic toilet seat 12 may further comprise a rear rise 12H and a lower relief area 12G, and the ergonomic toilet seat 12 may still further comprise a specific amount of angle 8 in the rear rise 12H of the seat 12 and a specific degree of drop 12F between the front portion 12B of the seat 12 and the lower relief area 12G where the lower pelvis parts rest while the seat 12 is in use. As shown, the rear rise 12H extends substantially linearly upwards from the relief area 12G to the rear end portion 12E, and results in the rear end portion 12E being disposed higher than the front end portion 12C. As shown, the relief area 12G is lower in height than the front end portion 12C and the rear end portion 12E. In certain embodiments, the upper surface of the front portion 12B is substantially horizontally disposed, and the upper surface tapers downwardly to the relief area 12G. In some embodiments, the angle θ of rise may be between about 10-18 degrees, and the specific drop 12F may be between about 35-50 mm. The inherent effectiveness of the ergonomic toilet seat assembly 10 protection of the design of the ergonomic toilet seat 12 may include those ranges. As shown, for example, in FIGS. 4-6, the lid 14 has a complementary contour to that of the seat 12 to nest therewith in a closed position.

In an exemplary embodiment, these components may be interrelated as follows. The connecting tabs 16 may connect the ergonomic toilet seat 12 to a toilet bowl 22. As mentioned above, the hinge assembly 16, 18, 20 may connect the ergonomic toilet seat 12 to the corresponding toilet lid 14. The hinge assembly 16, 18, 20 may further provide for hinged rotational movement of the corresponding lid 14 relative to the ergonomic toilet seat 12 for opening and closing of the lid 14 on the seat 12. In addition, the hinge assembly 16, 18, 20 may provide for hinged rotational movement of the ergonomic toilet seat 12 relative to the toilet bowl. The corresponding toilet lid 14 is constructed and arranged to cover the ergonomic toilet seat 12 as well as provide for support of the lower back during use at, for example, a protruding section 14B. The ergonomic toilet seat 12 may provide the main component for interfacing between the human anatomy and the toilet bowl.

In an exemplary embodiment, the ergonomic toilet seat assembly 10 may function and operate as follows. The connecting tabs 16 connect the assembly 10 to the toilet 22, allowing opening and closing of the ergonomic toilet seat assembly 10 for functional use and for appearance. The corresponding ergonomic toilet lid 14 covers the seat 12 and provides additional structural alignment and postural support of proper alignment to promote facilitated evacuation. The ergonomic toilet seat 12 is the foundation of all other components and provides the basis around which all other components function.

All elements of the ergonomic toilet seat assembly 10 as set forth hereinabove are desirable for optimal functioning of the invention as herein described. Though the lid 14 could be eliminated, that would diminish effectiveness and the overall function of the ergonomic toilet seat assembly 10.

None of the components of the ergonomic toilet seat assembly 10 may be shuffled as they are all interdependent. In an exemplary embodiment of the present invention, and as stated above, the ergonomic toilet seat assembly 10 of the present invention may comprise a specific amount of angle 8 in the rear rise 12H of the seat 12 and a specific degree/amount of drop 12F between the front portion 12B of the seat 12 and the lower relief area 12G where the lower pelvis parts rest. In particular, and as mentioned above, the angle θ of rise may be between about 10-18 degrees, and the specific drop 12F may be between about 35-50 millimeters (mm). In other embodiments, the specific drop 12F may be, for example, between about 25-50 mm, and those with skill in the art will appreciated that other appropriate ranges of drop 12F may be determined based on reasonable experimentation. The inherent effectiveness of the ergonomic toilet seat assembly 10 protection of the design of the ergonomic toilet seat may include those ranges.

In an exemplary embodiment, the ergonomic toilet seat assembly may be made or fabricated by, for example, injection molding from a digital model thereof. In one embodiment, the ergonomic toilet seat assembly 10 of the present invention may be installed and used by a process including one or more of the following steps and combinations thereof. To install, a current toilet seat (if present) is removed. The ergonomic toilet seat 10 is attached using the connection tabs 16. To use, the lid 14 is opened, and the seat 12 is sat on, with the user's back resting on the vertically standing lid 14.

In summary, an ergonomically correct toilet seat assembly 10 is provided. In an exemplary embodiment, the ergonomically correct toilet seat may comprise an ergonomic toilet seat 12 and an ergonomic toilet seat cover 14. In one embodiment, the ergonomic toilet seat assembly 10 may comprise an ergonomic toilet seat 12; a corresponding lid 14; a hinge assembly 16, 18, 20 between the lid 14 and the seat 12, the hinge assembly 16, 18, 20 including a plurality of connecting tabs 16 for connection of the ergonomic toilet seat assembly 10 to a toilet bowl 22. The ergonomically correct toilet seat assembly 10 offers better pressure distribution and comfort and promotes easier evacuation. The ergonomic toilet seat assembly 10 may provide anatomically correct relief for the lower pelvis parts, ischial tuberosities, as well as the sacrum, which simultaneously decreases pressure and promotes proper pelvic and spinal alignment and therefore decreased mechanical impediment to waste movement through the lower digestive tract. Further, as those with skill in the art will appreciate, while not specifically referenced in order to simplify the description of this particular embodiment, the above discussion regarding the structure of the seat 12 applies to both the left and right sides of the seat 12 as appropriate, e.g., the lower relief area and the rear rise.

For clarity, only those aspects of the system germane to the invention are described, and product details well known in the art are omitted. In addition, many embodiments of the present invention have application to a wide range of industries. To the extent the present application discloses a system, the method implemented by that system, is within the scope of the present invention. Further, to the extent the present application discloses a method, a system of apparatuses configured to implement the method are within the scope of the present invention.

While one preferred embodiment is disclosed, many other implementations will occur to one of ordinary skill in the art and are all within the scope of the invention. Furthermore, while the foregoing describes one embodiment of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

What is claimed is:

1. A toilet seat comprising:

a front portion with a front end portion, the front portion comprising a horizontally disposed upper surface that extends a first horizontal distance;

a relief area, in an intermediate portion thereof, that is:

lower in height than a height of the front end portion and a height of the rear end portion, the relief area comprising an upper surface that is approximately 25 to 50 millimeters lower than the upper surface of the front portion, and the relief area extending a second horizontal distance;

a rear portion with a rear end portion, the rear portion comprising a rear rise extending upwards from the relief area to the rear end portion; and a drop portion connecting the horizontally disposed upper surface and the relief area and extending a third horizontal distance, wherein the first horizontal distance is greater than the second horizontal distance and the third horizontal distance, combined.

2. The toilet seat of claim 1, wherein the rear rise extends upwards, at an angle, from the relief area to the rear end portion.

3. The toilet seat of claim 2, wherein the angle is between approximately 10-18 degrees.

4. The toilet seat of claim 2, wherein the upper surface of the front portion tapers downwardly to the relief area.

5. The toilet seat of claim 1, wherein the upper surface of the front portion tapers downwardly to the relief area.

6. The toilet seat of claim 5, wherein the front portion is thicker than the relief area.

7. The toilet seat of claim 1, wherein the front end portion is lower in height than the rear end portion.

8. The toilet seat of claim 1, wherein the relief area is positioned between the front end portion and the rear end portion such that the relief area is configured to support a lower pelvis of a user.

9. A toilet seat assembly comprising:

a toilet seat comprising:

a front portion with a front end portion, the front portion comprising a horizontally disposed upper surface that extends a first horizontal distance;

a relief area, in an intermediate portion thereof, that is:

lower in height than a height of the front end portion and a height of the rear end portion, the relief area comprising an upper surface that is approximately 25 to 50 millimeters lower than the upper surface of the front portion, and the relief area extending a second horizontal distance;

a rear portion with a rear end portion, the rear portion comprising a rear rise extending upwards from the relief area to the rear end portion; and a drop portion connecting the horizontally disposed upper surface and the relief area and extending a third horizontal distance, wherein the first horizontal distance is greater than the second horizontal distance and the third horizontal distance, combined; and a toilet lid configured to support a lower back of a user.

10. The toilet seat assembly of claim 9, wherein a top surface and a bottom surface of the toilet lid are non-planar.

* * * * *